US005339603A

United States Patent [19]

Gombault, deceased et al.

[11] Patent Number: 5,339,603

[45] Date of Patent: Aug. 23, 1994

[54] METHOD FOR SETTING A FOLDING STATION INCLUDED IN AN APPARATUS FOR PREPARING ITEMS TO BE MAILED, AND APPARATUS FOR PREPARING ITEMS TO BE MAILED AND FOLDING STATION ADAPTED FOR CARRYING OUT SUCH METHOD

[75] Inventors: Jacobus F. Gombault, deceased, late of Drachten; Petronella A. Gombault, legal representative, Bloemendaal; Gerhard Hidding, Heerenveen; all of Netherlands

[73] Assignee: Hadewe B.V., Drachten, Netherlands

[21] Appl. No.: 831,527

[22] Filed: Feb. 5, 1992

[30] Foreign Application Priority Data

Feb. 8, 1991 [NL] Netherlands ..... 9100228

[51] Int. Cl.[5] ..... B65H 45/12; B43M 3/04

[52] U.S. Cl. ..... 53/429; 53/117; 53/168; 53/284.3; 53/504; 493/476

[58] Field of Search ..... 53/117, 429, 504, 77, 53/569, 284.3, 502, 168; 493/444, 443, 435, 476, 420, 421

[56] References Cited

U.S. PATENT DOCUMENTS

| | | | |
|---|---|---|---|
| 4,843,802 | 7/1989 | Noll | 53/117 X |
| 4,917,662 | 4/1990 | Gombault | 493/416 |
| 4,944,136 | 7/1990 | Gough | 53/117 X |
| 4,985,013 | 1/1991 | van der Werff et al. | 493/444 |
| 5,067,305 | 11/1991 | Baker et al. | 53/117 X |

FOREIGN PATENT DOCUMENTS

| | | |
|---|---|---|
| 2738689 | 7/1980 | Fed. Rep. of Germany . |
| 2641499 | 7/1990 | France . |

OTHER PUBLICATIONS

Der intelligente Kuvertierer Halser KM8, macht einfach alles. Und alles einfach. Per Tastendruck. Hasler AG.

*Primary Examiner*—James F. Coan

*Attorney, Agent, or Firm*—Burns, Doane, Swecker & Mathis

[57] ABSTRACT

A method for setting a folding station included in an apparatus for preparing items to be mailed. This apparatus further comprises a document-supply station, an envelope-inserter station, transport means interconnecting these stations and setting means for setting at least the folding machine. For setting the fold height of a fold to be formed in a document or stack of documents, data are inputted to the setting means, these data representing the height of an envelope intended as a package for the document or the stack of documents. The fold height is determined and set by the setting means, at least partly depending on the inputted data representing the height of the envelope. The invention enables rapid and reliable setting of a folding station of an apparatus for preparing items to be mailed. The invention further relates to an apparatus for preparing items to be mailed, adapted for carrying out the present method and a folding station adapted for use as a part thereof.

31 Claims, 8 Drawing Sheets

METHOD FOR SETTING A FOLDING STATION INCLUDED IN AN APPARATUS FOR PREPARING ITEMS TO BE MAILED, AND APPARATUS FOR PREPARING ITEMS TO BE MAILED AND FOLDING STATION ADAPTED FOR CARRYING OUT SUCH METHOD

BACKGROUND OF THE INVENTION

This invention relates to a method for setting a folding station included in an apparatus for preparing items to be mailed, which apparatus further comprises a document-supply station, an envelope-inserter station, transport means interconnecting these stations, and setting means for setting at least the folding machine, wherein, for setting the fold height of a fold to be formed in a document or stack of documents, data are inputted to the setting means, these data representing at least the height of an envelope intended as a package for the document or the stack of documents, and the fold height referred to is determined and set by the setting means, at least partly depending on the inputted data representing the height of the envelope.

For a proper understanding of the present invention, some expressions as used herein with reference to the invention will now be explained.

The height of a document is the distance between two opposite edges thereof, transversely to the direction of a fold or folds formed or yet to be formed in the document. The height of a folded portion or a portion that is yet to be folded—the fold height—accordingly refers to the distance between a fold and the opposite edge of that portion. This opposite edge can be a fold or the top edge or bottom edge of the document. The height of an envelope is the distance between the folding edge along the closing flap of the envelope and the opposite folding edge. The documents are placed in the envelope in the direction of their height, "height direction" being an analogous expression used herein. Folds extending in the height direction of a document, i.e., crossfolds, will not be discussed with reference to the present invention. It is observed, however, that the invention can equally be used in the processing of documents that have been provided with a crossfold or are to be provided with one before being packed in an envelope.

Folding machines that are suitable for inclusion as a folding station in an apparatus for preparing items to be mailed are for instance known from U.S. Pat. Nos. 4,917,662 and 4,985,013 issued to assignee of the instant application.

Such folding machines can in a simple manner be set for determining a fold height and partly also for setting two or more fold heights. However, a problem involved here is that the setting of the fold height is still comparatively time-consuming and requires profound insight into the operation of the apparatus for preparing items to be mailed.

SUMMARY OF THE INVENTION

With the present invention, this problem is obviated in that it provides a method for setting a folding station included in an apparatus for preparing items to be mailed, which apparatus further comprises a document-supply station, an envelope-inserter station, transport means interconnecting these stations, and setting means for setting at least the folding machine, wherein, for setting the fold height of a fold to be formed in a document or a stack of documents, data are inputted to the setting means, these data representing at least the height of an envelope intended as a package for the document or the stack of documents, and the fold height referred to is determined and set by the setting means, at least partly depending on the inputted data representing the height of the envelope.

The height of the envelope can be determined in a simple manner, so that the laborious and time-consuming determination of the fold heights by trial and error can be eliminated.

A further advantage of the invention is that the setting time is strongly reduced, so that very small series and even loose postal items with envelopes of different size can be efficiently prepared in an arbitrary order.

The invention is further embodied by an apparatus for preparing items to be mailed, comprising a document-supply station, a folding station which can be set for determining a fold height of a fold to be formed in a document or stack of documents supplied from a document-supply station, and an envelope-inserter station, these stations being interconnected by transport means, and setting means for setting the folding station and provided with input means for inputting at least data representing the height of an envelope to be processed, the setting means being adapted for determining and setting the fold height of the fold referred to, depending on the inputted data referred to.

The apparatus according to the invention for preparing items to be mailed enables the method according to the invention to be carried out.

BRIEF DESCRIPTION OF THE DRAWINGS

Hereinafter, some embodiments of the invention will be further illustrated and explained, by way of example, with reference to the accompanying drawings, in which.

DETAILED DESCRIPTION

Figure 1:
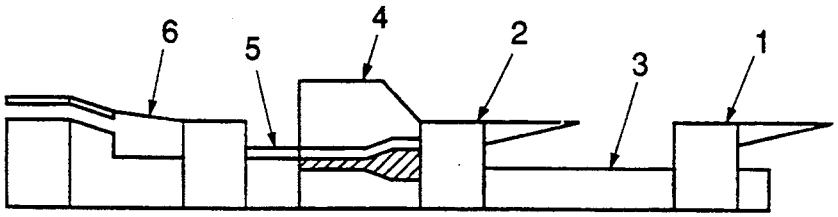
FIG. 1 is a side elevation of an apparatus according to the invention for preparing items to be mailed.

One example of an apparatus according to the invention for preparing items to be mailed is shown in FIG. 1. The apparatus shown comprises two document-supply stations 1 and 2 arranged along a transport track 3. A folding station 4 which can be set for determining a fold height of at least one fold to be formed in at least one document supplied from one of the document-supply stations 1, 2 is arranged downstream of the second supply station 2. Connected to the folding station 4 is a transport unit 5 having an envelope inserter station 6 connected thereto. From the supply stations 1 and 2, sets of documents can be supplied. The documents can be folded in the folding station 4, in such a manner that they can be placed in the corresponding envelopes in the inserter station 6.

Figure 4:
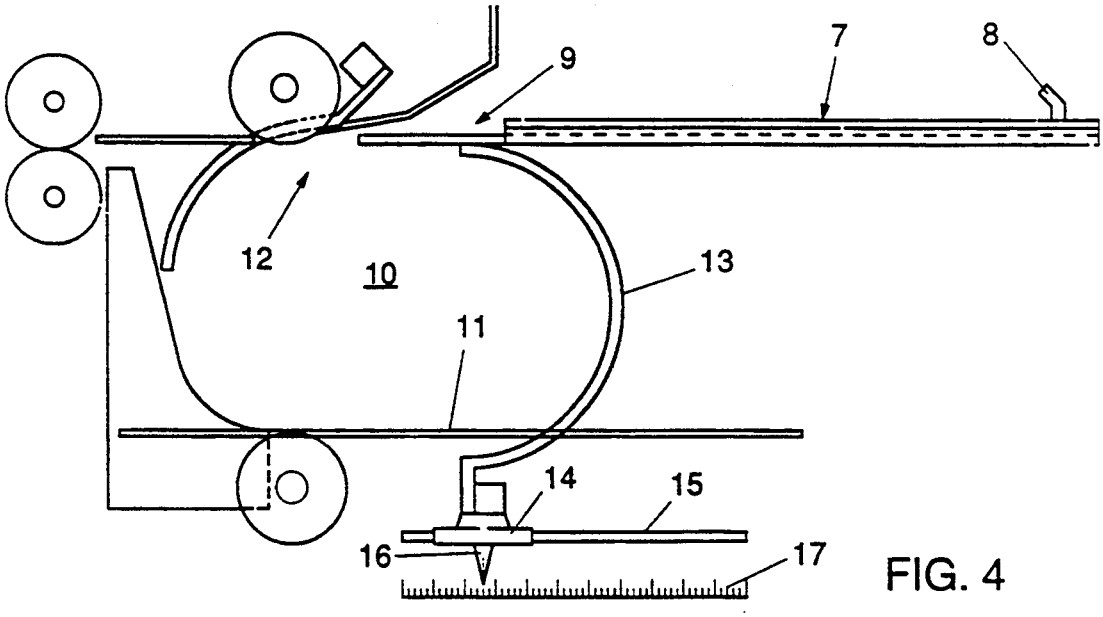
FIG. 4 is a diagrammatic side elevation of a second settable folding machine.

The folding station can be designed as shown in FIG. 4. Such a folding machine is described in more detail in the above mentioned U.S. Pat. No. 4,917,662, the contents of which are incorporated herein by reference.

Such a folding machine comprises a feed track 7 along which a finger 8 can be moved for supplying the documents to be folded. The feed track 7 terminates in front of a passage 9 giving access to a drum-shaped compartment 10. The drum-shaped compartment 10 has a circumference such that a document fed into it will roll up. By moving a pressure member 11 through the compartment 10 to a stop surface 12, a rolled-up document or set of documents can be flattened and thereby folded.

The relative distance between the folds defines the height of a folded document or set of documents. This relative distance is determined by the magnitude of the circumference of the drum-shaped compartment 10. This circumference can be set by moving the position of a wall element 13 which defines a part of the drum-shaped compartment 10. For that purpose, the wall element 13 is pivotally mounted on a slide 14 which can be displaced along a rail 15. The slide 14 is coupled to an indicator 16 which moves along a scale 17 upon displacement of the slide. The scale 17 is so designed that when the indicator 16 is moved opposite a position on scale 17 corresponding with the height of the envelope in which the documents are to be inserted, the wall element 13 is so positioned that the circumference of the drum-shaped compartment 10 permits a document to be rolled up in such a manner that, after being flattened, it comprises a plurality of folds, the fold heights of these folds having been so chosen that the document fits into the envelope with a predetermined clearance.

The number of folds is automatically adjusted to the length of the document to be folded, in that it is pushed along the internal circumference of the drum-shaped compartment 10 as often as is necessary.

The wall element 13, the slide 14, the rail 15 form setting means of the folding station, which are coupled to input means formed by the indicator 16 and the scale 17 for inputting data representing the height of an envelope to be processed. By bringing the indicator 16 in a position where it indicates a position on the scale 17 corresponding with the height of an envelope to be processed, the height of that envelope is inputted to the folding station. The setting means 13, 14, 15 are adapted for determining and setting the fold height of a fold to be formed in a document, depending on the inputted data referred to, i.e., the position of the indicator 16 relative to the scale 17.

Because the height of the envelope to be processed can be inputted directly into the folding station, the setting of the folding station is appreciably simplified.

According to a preferred embodiment of the invention, the setting means further comprise data processing means having stored therein a folding program for setting the folding station, the input means are coupled to the data processing means for inputting therein the data as a parameter value, and the folding program includes: at least one input parameter for storing the parameter value referred to, an output parameter for setting the folding machine and an algorithm for assigning a parameter value to the output parameter, depending on the parameter value assigned to the input parameter.

This makes it possible for the setting of the folding station to be carried out very quickly and accurately. It further provides the possibility of calling up in a simple manner data regarding envelopes to be processed from a memory and to input them as part of a total setting of the apparatus, which can be called up in its entirety. A flowchart of one example of an algorithm for setting the folding station is shown in FIGS. 8–13 and will be further discussed and explained hereinafter.

According to a further embodiment of the invention, the inputting means are further adapted for inputting a parameter value which represents the height of the document to be folded and inserted in the envelope, for determining the fold height of at least one fold to be made relative to an edge of the document to be folded, partly depending on the inputted parameter value representing the height of the document.

This provides the possibility of further inputting data that represent the height of a document to be packed. This, in turn, provides the possibility of also setting folding machines which require that the height of the documents to be processed is known for determining the number of folds and the fold heights thereof, without the operator having to determine the fold heights.

Figure 2:
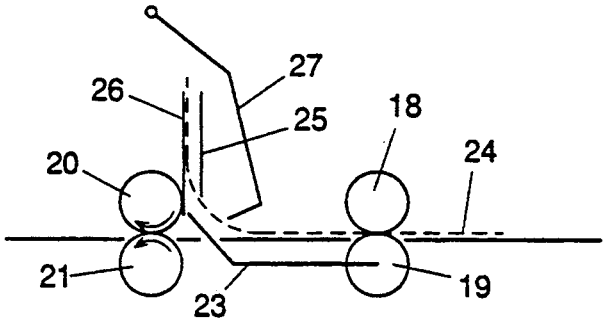
FIG. 2 is a diagrammatic side elevation of a settable folding machine to which a sheet to be folded has been fed.
Figure 3:
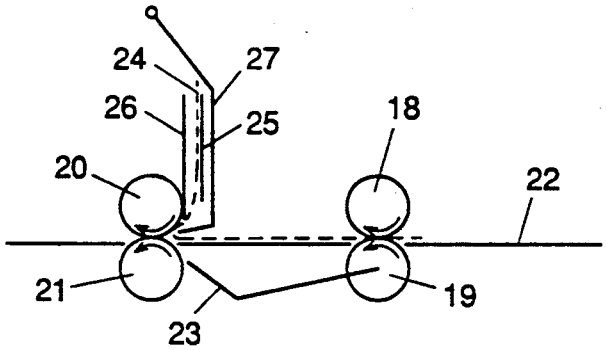
FIG. 3 is a further side elevation of the folding machine of FIG. 2, in a subsequent stage of the folding of the sheet supplied.

An example of such a folding machine is diagrammatically shown in FIGS. 2 and 3 and is described in more detail in the above mentioned U.S. Pat. No. 4,985,013.

The folding machine shown in FIGS. 2 and 3 comprises two pairs of rollers arranged in succession, the rollers 18, 19 and 20, 21 being arranged opposite each other on either side of a transport track 22. Arranged between the pairs of rollers is a deflection member 23 for guiding a leading portion of a document 24 to be folded out of the transport track 22 and between two guide members 25 and 26. When the leading portion has been passed from the transport track 22 and between the guide members 25 and 26 over a certain distance, for instance as shown in FIG. 2, the deflection member 23 is removed from the transport track and the document is bent further by a folding blade 27 and forced between the second pair of rollers 20 and 21. The rollers 20, 21 form a fold in the portion that has been bent further. The fold height of a fold is determined by the distance over which the leading portion of the document 24 is passed on by the first pair of rollers 18, 19, before a portion of the document 24 is bent further and forced between the second pair of rollers 20, 21.

The fold height of a fold can be set in a simple manner by controlling the rotation of the first pair of rollers 18, 19 upon passage of the leading edge of the document 24. In that case, it is not necessary to displace stops or the like. For forming a second fold, there may for instance be provided a third pair of rollers with associated deflection and guide means as well as an associated folding blade, while the rollers of the second pair of rollers 20, 21 simultaneously function as feed rollers for the third pair of rollers. If a second fold is to be provided, the deflection member associated with the third pair of rollers can be operated upon supply of a document for guiding a leading portion of that document out of the transport track.

When using the present invention in a folding machine of the type as shown in FIGS. 2 and 3, the setting means preferably comprise data processing means for determining the number of folds to be provided in a document or stack of documents and the fold heights thereof, depending on the inputted height of an envelope to be processed and a document or stack of documents to be inserted therein, and for determining the control commands for the deflection means and the folding blades as well as the rotations of the associated feed rollers after the passage of a leading edge of a document, before the associated folding blade must be operated for bending the document further and urging it between the folding rollers.

The height of an envelope to be processed and, if necessary, the height of a document or stack of documents to be packed therein, can be inputted by the operator. It is preferred, however, that the data concerning the heights of documents and envelopes are determined by the apparatus for preparing items to be mailed, so that the operator need not determine these by measurement. This can for instance be effected by calling them up from a memory in which the heights of types of envelopes and documents are stored. Use can also be made of sensors arranged in the apparatus for preparing items to be mailed and coupled with the setting means, which sensors scan the height of an envelope or a document to be packed therein and generate a signal that is dependent on the outcome of the scan, represents the height of at least one document and is inputted to the setting means.

For determining the height of a document to be processed, the apparatus according to the invention for preparing items to be mailed preferably comprises measuring instruments for determining the parameter value representing the height of a document to be processed, these measuring instruments being coupled with the input means for inputting this parameter value.

For determining the height of an envelope to be processed, the apparatus according to the invention for preparing items to be mailed preferably comprises measuring instruments for determining the parameter value representing the height of an envelope to be processed, these measuring instruments being coupled with the input means for inputting this parameter value.

A reliable, accurate setting of the height of an envelope to be processed or a document or stack of documents to be packed therein can be obtained if the measuring instruments comprise a scanning roller which, in the area of a transport track, is in engagement with a surface, associated data processing means, a rotation sensor which can supply to the associated data processing means a signal representing the path which the scanning roller has traversed over the envelope, a document or stack of documents which are passed along the scanning roller in the direction of their height.

During the passage of an envelope, document or stack of documents, the scanning roller is rolled over the envelope, the document or the stack of documents from the leading to the trailing end thereof, while the rotation of the scanning roller is scanned and registered.

Figure 14:
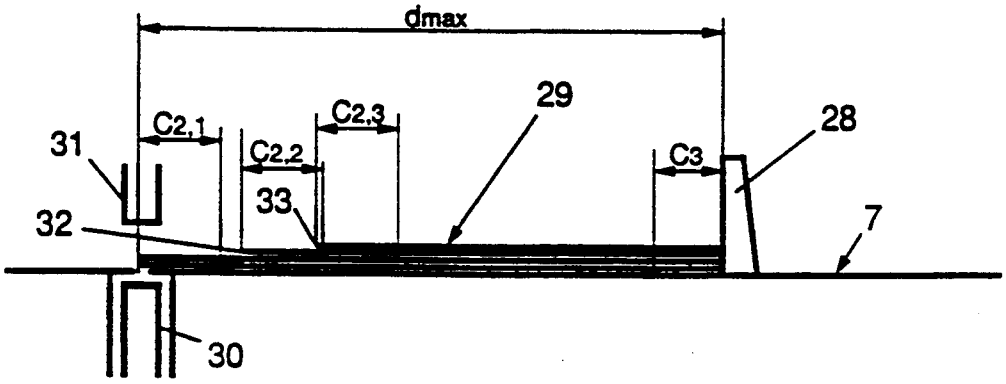
FIG. 14 is a side elevation of a plurality of documents to be folded, collected into a stack.
Figure 8:
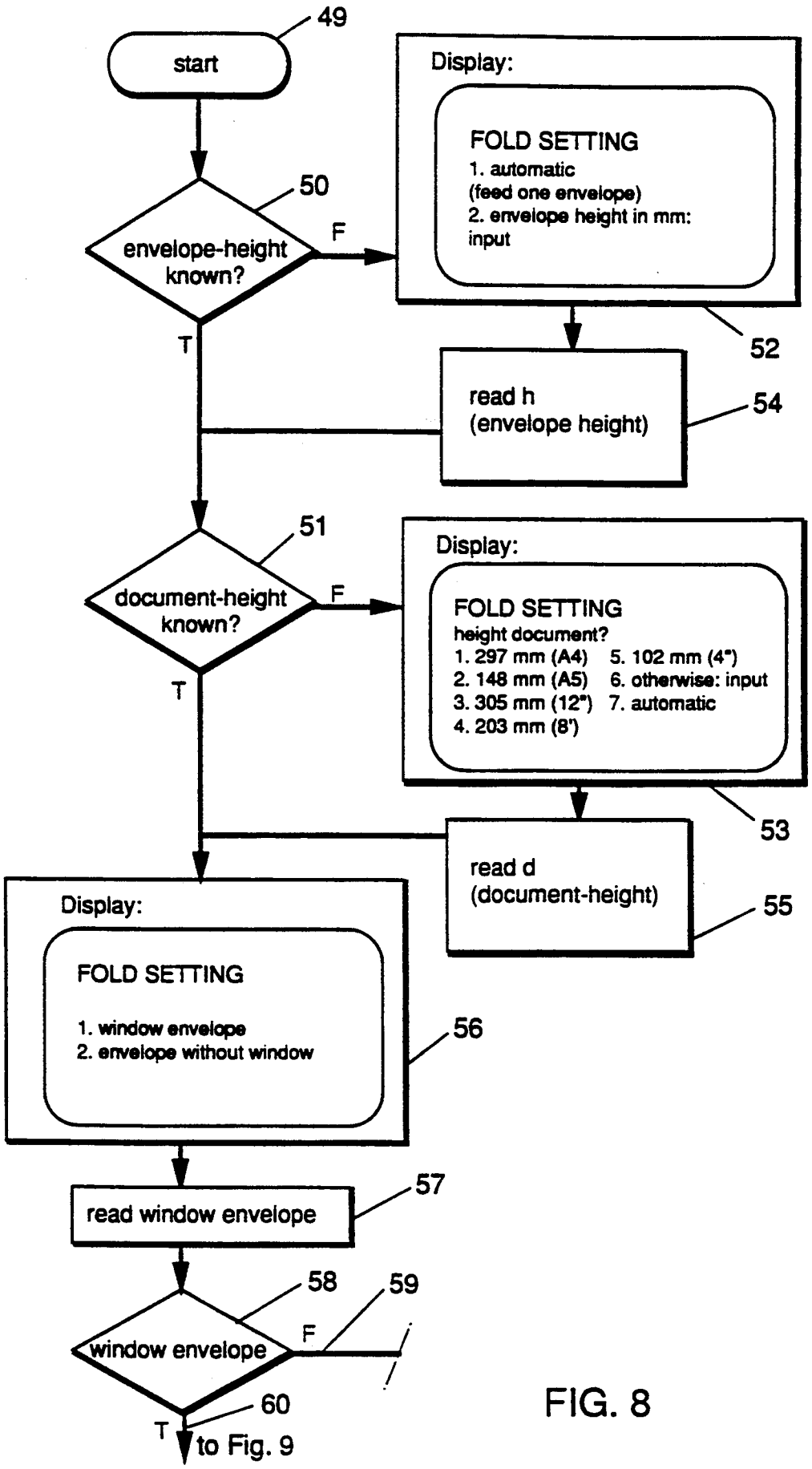
FIGS. 8–13 show a flowchart of one example of a part of an algorithm for carrying out the method according to the invention.

The apparatus according to the invention for preparing items to be mailed may comprise supply means, such as the supply stations 1 and 2 of FIG. 1, which can supply a plurality of documents for each postal item to be prepared and which are arranged for supplying documents of different heights, as well as collecting means for collecting the documents supplied for each postal item into a stack, these collecting means comprising a stop 28 which the documents can abut against in the direction of their height, so that the documents to be packed can be collected to form a stack as shown in FIG. 14. In that case, the measuring instruments for determining the parameter value representing the height of a document to be processed preferably comprise scanning means for detecting the height, measured from the stop 28, of the highest document of a stack 29 formed in abutment with this stop. This has the advantage of enabling measurement of the height of the stack without measurement of each document separately.

The measuring instrument may for instance comprise a light-sensitive cell 30 and a light source 31. The stop 28 is movable along the track 7 and the distance between the stop 28 and the light-sensitive cell 30 is detected. The distance from the stop 18 to the light-sensitive cell 30 at the time when the light beam is interrupted provides a measure for the height of the stack of documents 29.

According to an alternative embodiment of the invention, the apparatus for preparing items to be mailed comprises measuring instruments for determining for each document supplied a parameter value representing the height of the document, a folding routine incorporated in the folding program for setting the folding station, such as the program of which a part is shown as a flowchart in FIGS. 8–13, including: input parameters for storing the parameter values each associated with one of the documents, which parameter values represent the height of the respective document, an intermediate parameter for indicating the height of the highest document of a stack and an algorithm for assigning a value to the last-mentioned intermediate parameter, depending on the inputted parameter values each representing a height of one of the documents supplied.

Because the sensors scan the height of each separate document for each postal item to be prepared from a plurality of documents of mutually different heights, the height of the stack can be determined independently of the formation of the stack and as soon as the heights of types of documents to be formed into a stack are known, a signal representing these heights can, upon supply of such documents, be supplied from a memory to the data processing means of the setting means of the folding machine, so that the preparation of the postal items is not delayed by the intermediate determination of the height. A further advantage is that the height of a stack may already be known before the formation of the stack, so that the determination of the fold height or fold heights and, if necessary, of the number of folds as well as subsequent setting of the folding station can be started before the stack is actually formed.

When supply means are used such as the supply stations 1 and 2 of FIG. 1 for supplying a plurality of documents for each postal item to be prepared, which supply means are adapted for supplying documents of mutually different heights, and collecting means for collecting the documents supplied for each postal item into a stack 29 (FIG. 14), comprising a stop 28 which the documents can abut against in the direction of their height, it is advantageous if the length of each document of a stack 29 is known, so that the positions of edges 32, 33 of the documents, which edges are disposed on the outside of the stack, are determined. These positions are relevant when processing the stack in a folding machine which requires that a minimum distance is provided between a fold and the leading or a trailing edge of a document. With reference to the stack 29 of FIG. 14 as an example, it is assumed that the end of the documents in abutment with the stop 28 forms the trailing end and that each outer leading edge has a contiguous fold-height zone of a height $C_{2,x}$, where no folds can be formed. Accordingly, the stack 29 has the fold-height zones $C_{2,1}$, $C_{2,2}$, and $C_{2,3}$, where no fold can be made. Further, contiguous to the trailing edge is an area $C_3$ where no fold can be made either.

To allow for such limitations in the provision of a fold as discussed in the present example, the referenced folding program routine can further comprise: intermediate parameters for storing the heights of documents having a top or bottom edge disposed on the outside of a stack of documents collected into a stack and to be processed into a postal item, output parameters for indicating fold-height zones to be excluded and an algorithm for assigning parameter values to the intermediate parameters, depending on the values and the sequence of the input parameters, as well as for determining the last-mentioned output parameters, depending on the values of the intermediate parameters.

By means of the referenced folding program routine, it can be determined, in respect of a stack of documents whose top or bottom edges are superposed in a straight line in the stacking direction, which of the parameter values represent heights of documents whose respective opposite edge is on the outside of the stack, the parameter values used in determining the at least one fold height being used for determining and avoiding the fold-height zones such as the fold-height zones $C_{2,1}$, $C_{2,2}$ and $C_{2,3}$ in the stack 29, where no fold can be made.

In further elaboration of the invention, at least one reference value representing a possible property of a set of documents to be processed into a postal item is inputted to the data processing means. At least one parameter value representing a property of a set of documents to be processed into a postal item is determined for each set of documents to be processed into a postal item and inputted to the data processing means. This parameter value is compared with the reference value referred to by the data processing means. On the basis of the outcome of this comparison, for each postal item to be prepared, an envelope is then chosen from at least two envelopes of mutually different heights, with at least the parameter value representing the height of the selected envelope being inputted to the data processing means and being used as a starting point for determining the fold height.

By processing more than one type of envelope as required, the range of application of the automatic determination of a fold height on the basis of the height of the envelope is enlarged in that prior to the determination of a fold height a suitable envelope for a document or set of documents to be mailed is automatically chosen from at least two options.

For carrying out the method according to this further elaboration of the invention, the inserter station may comprise at least two envelope supply holders, supply means for supplying an envelope from one of the envelope supply holders, activating means for activating a given envelope supply holder for each postal item to be prepared, which activating means are coupled to the data processing means in which an envelope-selection program is stored, including: at least one input parameter for storing a parameter value representing the envelope height of an envelope present in one of the supply holders, at least one input parameter for storing a parameter value representing a property of a set of documents to be packed, at least one input parameter for storing a reference value with which the last-mentioned parameter value can be compared, an output parameter for activating one of the envelope supply holders and an algorithm for assigning a value to the output parameter for activating one of the envelope supply holders, depending on the outcome of the described comparison.

A parameter value which represents a property of a set of documents to be processed into a postal item and on the basis of which an envelope is selected, may be, for instance, the number of documents from which that set is being or has been prepared. According as more documents are to be mailed, a larger envelope can be selected, for instance to avoid having to fold a thick package of documents.

A further parameter value which represents a property of a set of documents to be processed into a postal item and on the basis of which an envelope is selected may be, for instance, the yes/no-supply of a document from a given document supply station. Documents from a given document supply station may be, for instance, partly or wholly unfoldable or may bear the address in a position which is compatible only with a specific type of window envelope.

The selection of an envelope on the basis of the yes/no supply of a document from a given document supply station may be, for instance, effected by associating with a document supply station a parameter value which represents a height of a not to be folded part of a document to be supplied by the supply station. This parameter value, when a document is supplied from the relevant document supply station, is used in the selection of an envelope as a parameter value representing a property of a set of documents to be processed into a postal item for determining a required minimum envelope height, and, in determining the at least one fold height, is used for determining fold-height zones to be avoided.

In this manner, a parameter value which represents the height of a document is used both for selecting an envelope and for determining the fold zones to be avoided.

A yet further parameter value which represents a property of a set of documents to be processed into a postal item and on the basis of which an envelope is selected, may be, for instance, obtained by determining the weight of the set of documents in question. In certain cases, it will be desirable that a heavier set of documents is packed in a larger and/or stronger envelope than that used for a lighter set of documents. In practice, a larger envelope will nearly always have a different height from that of a smaller envelope, so that the number of folds to be made and the fold heights thereof must be determined starting from a different, greater envelope height.

One reason for choosing a different envelope than the one originally chosen may be that a fold height determined for packaging a set of documents in the envelope selected, falls within a fold-height zone where no folds can be made. Preferably, the data processing means will then choose a different envelope of a height different from the height of the envelope originally chosen. Thus, the universal application of the method and the apparatus according to the invention is further increased.

In the packaging of documents in window envelopes, it is important that the address is properly visible behind the window after the document bearing the address has been inserted into the envelope. Assuming the position of the address viewed in transverse direction is compatible with the transverse position of the window of the envelope to be processed, then the orientation of the document bearing the address, as well as the number of folds in the document and, if folding is required, the fold height of at least one fold, all must be such that the address will also correspond with the position of the window in height direction, facing the window.

In accordance with an elaboration of the invention, to obtain a proper height and orientation of the address relative to the window of the envelope, further parameter values may be inputted to the data processing means, which respectively represent a distance from an edge of an address field on a document to be processed to a bottom or top edge of the document and a distance from an edge of a window in an envelope intended for packaging of the document to a bottom or top edge of the envelope, while the fold heights are determined and set by the data processing means in such a manner that, after insertion of the document in the envelope, the address field is located behind the window of the envelope and the document bearing the address field fits into the envelope with a slight clearance in height direction.

In accordance with a further elaboration of the invention, to obtain a proper height of the address relative to the window in the processing of a particular type of window envelope and a particular type of document with an address field, which type of document fits into the envelope with a slight clearance in height direction after having been folded at least once, after the fold height of that fold has been determined and set, at least one correction cycle can be performed. In that case, the data processing means control a display for showing the possible displacement of the fold in height direction as a possible displacement of the address field in a height direction relative to the window, a test cycle is performed in which a document with an address field in a same position as the position of the address field of said document and an envelope identical to the envelope in question are processed into a postal item, and the operator inputs a parameter value to the data processing means, which parameter value represents a desired displacement of the address in height direction relative to the window. After completion of the last correction cycle, the fold height found is stored in the data processing means.

Such a setting procedure has the advantage of rendering it unnecessary to measure the position of the envelope and of the window. After running a test cycle, wherein the position of the address field relative to the window has been set on the basis of a rough estimation, it can be checked whether the position of the address needs correction. The extent of the necessary correction likewise can be estimated in a simple manner, whereafter a subsequent test cycle can be run so as to check whether the correction has led to a proper setting of the fold heights. The setting is each time adjusted on the basis of a test item that corresponds to a postal item such as will be obtained with the fold heights as set. This makes it easy for the operator to arrive at the proper corrections and minimizes the risk of errors, which would lead to the preparation of a large number of postal items bearing an address that is not visible or only partly visible through the window.

The flowchart of FIGS. 8–13 shows a part of a program for carrying out a setting procedure as described hereinabove.

Preferably, the nominal clearance and the choice between a zigzag folding pattern and a wrapping folding pattern of the document are stored in the data processing means as a fixed preferred setting, so that it is not necessary in each case to input these data for preparing a new package of postal items.

Figure 5:
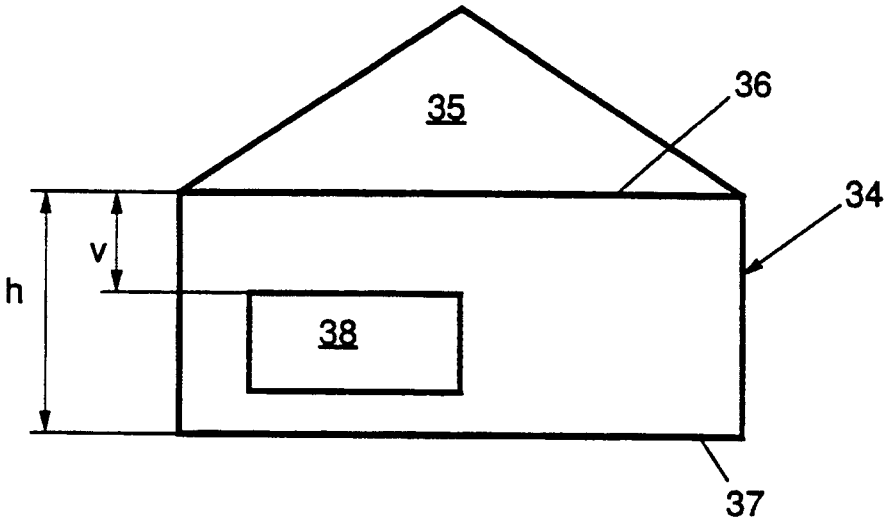
FIG. 5 is a view of an envelope.
Figure 6:
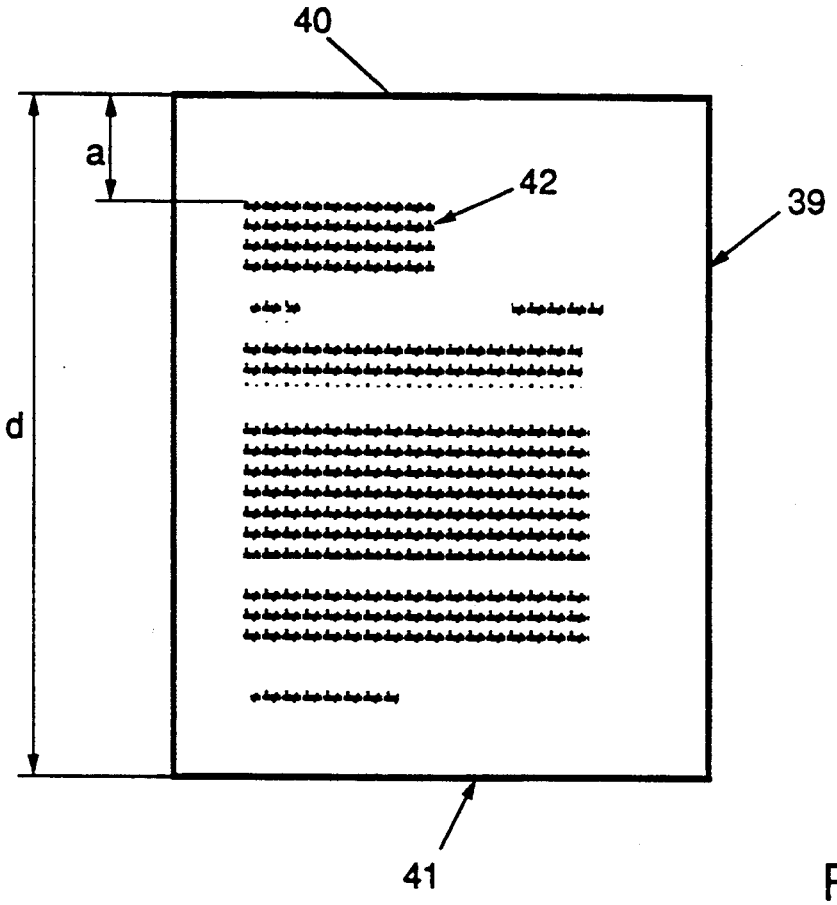
FIG. 6 is a view of a document intended to be packaged in the envelope of FIG. 5.
Figure 7:
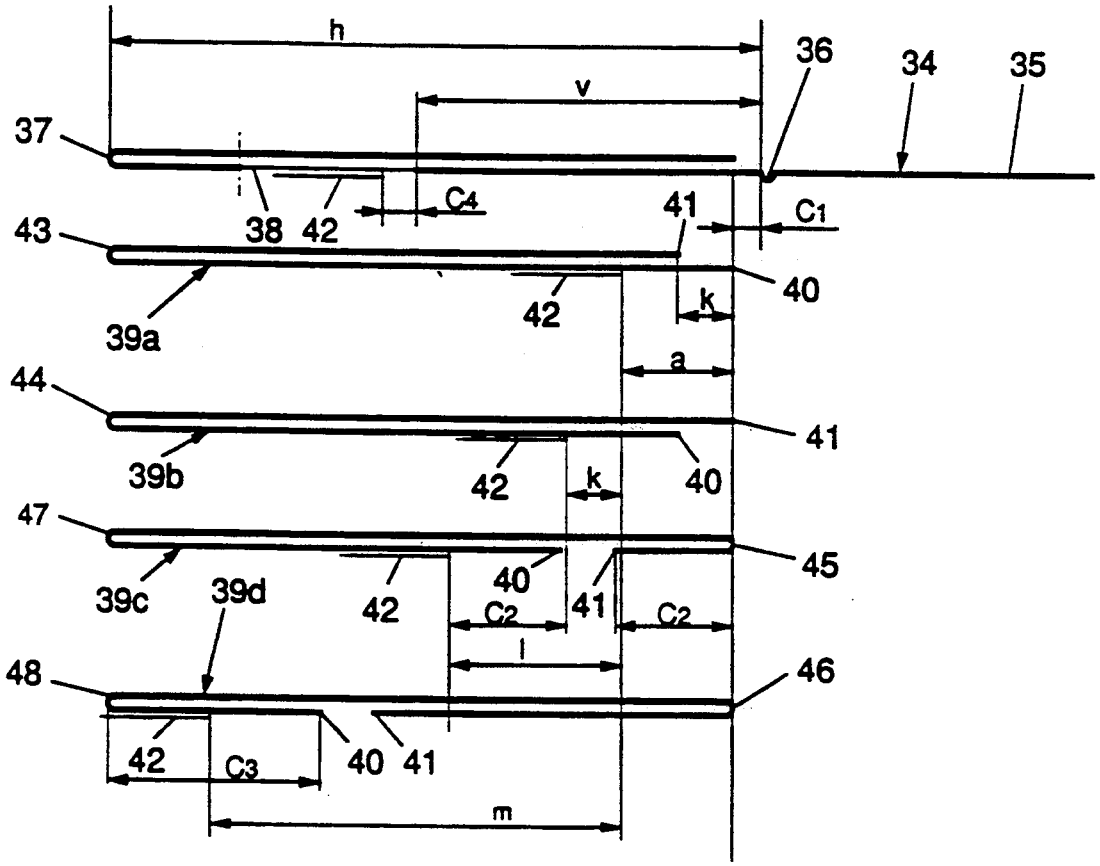
FIG. 7 is a diagrammatic sectional side elevation of an envelope and a plurality of documents intended to be packed in an envelope as shown in this figure.

FIGS. 5–7 show the relevant data for packaging a document with an address in a window envelope, in such a manner that the address is visible behind the window after packaging.

FIG. 5 shows an envelope 34 having a closing flap 35, a folding edge 36, a folding edge 37 opposite therefrom and a window 38. The height h of the envelope is the distance h between the folding edge 36 along the closing flap 35 and the opposite folding edge 37. The letter v indicates the distance from the top edge of the window 38 to the folding edge 36 along the closing flap 35.

FIG. 6 shows a document 39 having a top edge 40, a bottom edge 41 and an address field 42. The letter d indicates the distance between the top edge 40 and the bottom edge 41 of the document, i.e. The document height. The letter a indicates the distance from the address field to the top edge 40.

FIG. 7 shows the envelope 34 and, below it, four documents 39*a*, 39*b*, 39*c*, and 39*d* having folds of different fold heights. In folded condition, the documents 39*a*, 39*b*, 39*c*, and 39*d* each have a clearance C1 relative to the envelope height h and accordingly each have a height h−C1.

In the present example, it is assumed that folding is carried out in such a way that the bottom edge 41 forms the leading edge when document 39*a*, 39*b*, 39*c*, or 39*d* is being fed to the means for forming a first fold 43, 44, 45 or 46 and that when a second fold 47 or 48 is being provided, the first fold 43, 44, 45, or 46 forms the leading edge.

Preferably, in addition to the clearance C1 and the choice between a zigzag fold and a wrapping fold, the following are also stored in the data processing means as a fixed preferred setting:

the minimum distance C2 (in height direction) from a fold 43, 44, 45, 46; 47, 48 to the leading edge 41; 43, 44, 45, 46;

the minimum distance C3 (in height direction) from a fold 43, 44, 45, 46; 47, 48 to the trailing edge 40.

These distances are determined by the properties of the folding machine that is used. C4 indicates the intended distance between the top edge of an address field 42 and the top edge of a window 38. If a method is used in which the distance a from the address field 42 to the top edge 40 of a document 39 and the distance v from the window 38 to the folding edge 36 along the flap 35 are directly inputted to the data processing means, it is preferred that the intended distance C4 is also stored in the data processing means as a fixed preferred setting.

Of the documents shown in FIG. 7, document 39*a* has a single fold 43 at a distance h−C1 from the top edge 40. The distance from the top edge of the address field 42 to the folding edge 36 along the flap 35 of the envelope 34 is therefore at least the distance a from the top edge of the address field 42 to the top edge 40 of the document 39*a* and at most the sum of distance a and the intended clearance C1. On this first document 39*a*, after its being inserted in the envelope 34, the distance a from the top edge of the address field 42 to the top edge 40 of the document 39*a* equals the distance from the top edge of the address field 42 to the folding edge 36, not counting clearance C1.

In document 39*b*, a fold 44 has been formed at a distance h−C1 from the bottom edge 41. In this second document 39b, after its being inserted in the envelope 34, the top edge 40 of the document 39b is located at a distance 2(h−C1)−d=k from the folding edge 36 along the flap 35 of the envelope 34, not counting clearance C1. The distance from the top edge of the address field 42 to the folding edge 36 along the flap 35 of the envelope 34 equals a+k, not counting clearance C1. On this second document, the position of the address field 42 relative to the window 38, compared with the position on the first document 39a, has been lowered by a distance k.

The documents 39c and 39d each comprise two folds 45, 47 and 46, 48, respectively. In the third document 39c, the first fold 45 is located at a distance C2 from the top edge 41 of the document 39c. A smaller distance between the top edge 41 of the document 39c and the fold 45 is not possible in the method of folding used in this example. The address field 42, after insertion of the third document 39c in the envelope 34, has been lowered relative to the window 38 and compared with the position of the address field 42 on the first document 39a, by a distance 1. The position of the address field 42 after insertion of the third document 39c in the envelope 42 is the highest possible position of the address field 42 in a document provided with two folds.

In the fourth document 39d, the second fold 48 has been formed at the minimum distance C3 from the trailing bottom edge 40 of document 39d. The first fold 46 is located at a distance h−C1 from the second fold 48 so as to obtain a proper fit for the document 39d in the envelope 34 with the intended clearance C1. The position of the address field 42 of the fourth document 39d, after insertion thereof in the envelope 34, is the lowest possible position of the address field 42 when a document 39 according to the present example is provided with two folds. The position of the address field 42 in the fourth document 39d has been lowered by a distance m=h−C1−C3 relative to the position of the address field 42 in the first document 39a.

The lowering 1 and the lowering m are the extremes of a lowering range within which the top edge of the address field 42 can be located when the document 39 according to the present example is provided with two folds and fits into the envelope 34 with the intended clearance C1. As appears from FIG. 7, a lowering between 1 and m of the address field, and hence the provision of two folds in the document 39, is required to achieve an arrangement wherein the address field 42 of the document 39, after insertion of the document 39 into the envelope 34, will be visible through the window 38 of the envelope 34.

The flowchart as shown, by way of example, in FIGS. 8–13 will now be further explained. This flowchart describes a main routine of a folding program for positioning an address field behind the window of an envelope.

After the program has been started (FIG. 8), as denoted by symbol 49, it is checked by program elements denoted by symbols 50 and 51 whether the heights of the envelopes to be processed and the documents to be packed are known. If they are not, these heights can be inputted, or be determined by the apparatus for preparing items to be mailed itself by scanning one envelope or one document fed to the apparatus. To the operator, displays as denoted by symbols 52 and 53 are shown. The heights as inputted or determined are read by the data processing means and stored therein; see symbols 54 and 55.

Then the program issues a command to display a view as denoted by symbol 56, which requests the operator to indicate whether window envelopes or envelopes without windows are to be processed. If it is read in (see symbol 57) that envelopes without windows are to be processed, the program, as denoted by symbol 58, will proceed along branch 59, which leads to a routine that determines the number of folds and the fold heights in such a way that the document fits into the envelope as well as possible. This program routine is not shown and preferably differs from the routine designed for packaging a document in a window envelope only in that it offers no option of moving the address field relative to a window and in that no display is shown when the document can only be packed in an envelope with a greater clearance than the intended clearance C1.

If, during the operation designated by symbol 57, it is read in that documents must be packed in window envelopes, the program opts for progression along branch 60 leading to a routine for setting the number of folds and the fold heights for processing window envelopes.

Figure 9:
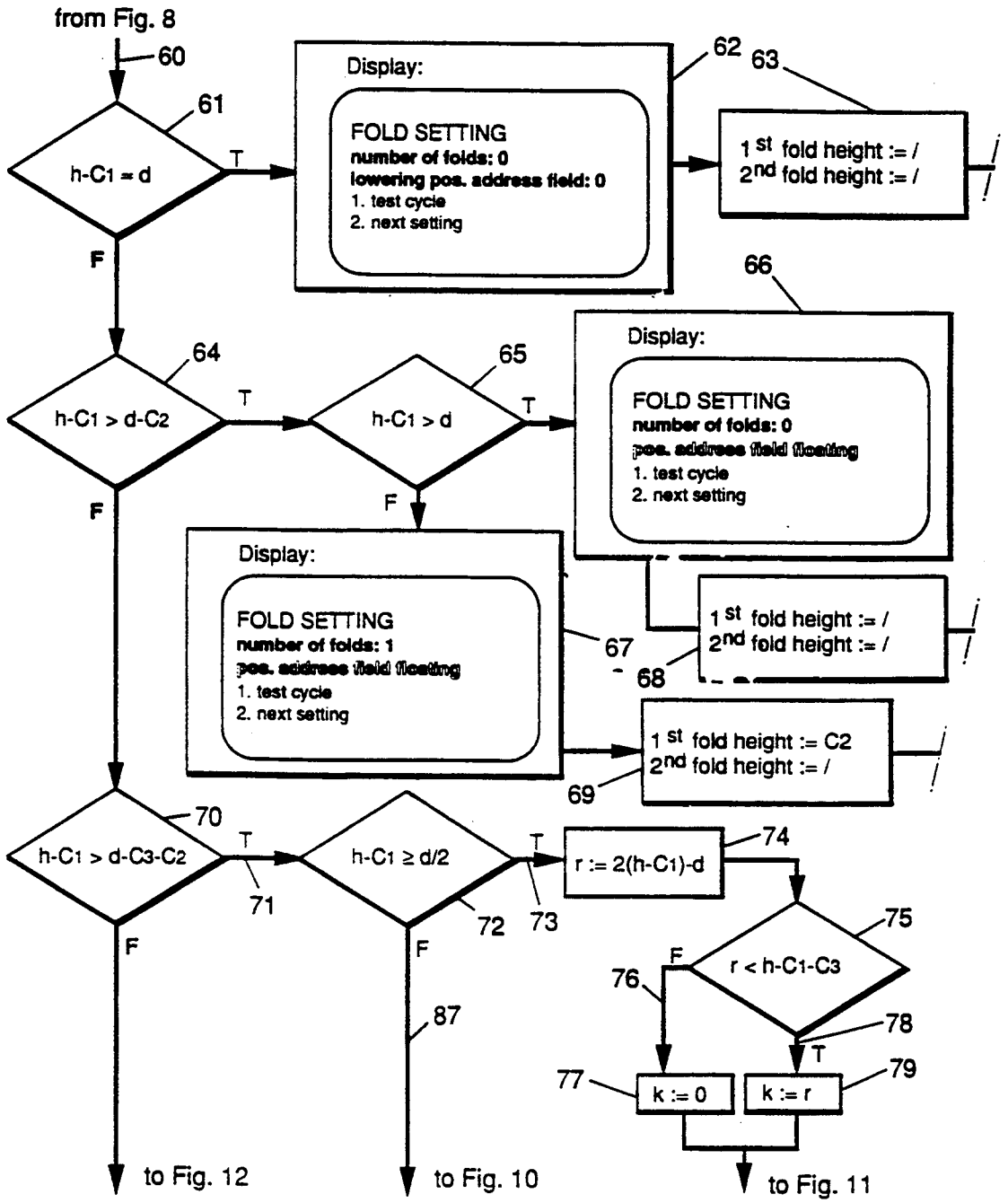

As shown in FIG. 9, the first step 61 of the routine for setting window envelopes comprises a comparison of the height d of the document and the height h of the envelope minus the intended clearance C1. If they correspond—naturally allowing for a certain tolerance—the document in unfolded position fits exactly into the envelope and the address field will be located at a distance from the folding edge of the envelope which, not counting the clearance C1, equals the distance a up to the top edge of the document. Accordingly, as shown by symbol 62, the display then indicates that the lowering of the address field equals 0. The operator is offered the option of running a test cycle or to proceed to the next setting of the apparatus for preparing items to be mailed. This may, for instance, concern the setting of a franking apparatus. As indicated by symbol 63, the folding station is set by the data processing means for passing on each document supplied without providing a fold therein. The routine of the program following the element designated by symbol 63 can be of similar design to that of a corresponding routine for setting a known folding machine where the number of folds and the fold heights must be set by the operator, and hence is not shown.

If the unfolded document does not fit into the envelope with the intended clearance C1, it is checked whether the envelope height h minus the intended clearance C1 is greater than the document height d minus the minimum fold height C2, as indicated by symbol 64. If such is the case, there are two ways in which the document can be arranged in the envelope. If the document height d is smaller than the envelope height h minus the intended clearance C1, the document can be arranged in the envelope without being folded—fold setting according to symbol 68; if the document height d is greater than the envelope height h minus the intended clearance C1, the document can be arranged in the envelope with a single fold having a fold height of C2, measured from the leading (bottom) edge—fold setting according to symbol 69. The choice between these two options is made by the program element denoted by the symbol 65. In either case, however, the document will fit into the envelope with a greater clearance than the intended clearance C1. As a result, the position of the address field relative to the window is more variable than intended. As indicated in symbols 66 and 67, this is shown on the display by the designation "position address field floating". The routines following symbols 68 and 69, like the routine following symbol 63, can be of similar design to that of corresponding routines of a folding machine where the number of folds and the fold heights thereof must be inputted by the operator.

When it has been established that the document having a single fold of a minimum fold height C2 is not lower than the envelope height h minus the intended clearance C1 ($h-C1>d-C2$ is false), then, as indicated by symbol 70, it is checked whether the envelope height h minus the intended clearance C1 is greater than the height of a document having a first fold of a minimum fold height C2 and a second fold having a maximum fold height, i.e. having a distance C3 up to the trailing (top) edge. A document having two folds as mentioned has a height $d-C3-C2$. If the condition according to symbol 70 is met, a document cannot be provided with two folds such that the middle portion between the two folds has a length $h-C1$ and accordingly fits into the envelope with the intended clearance. In that case, the program proceeds along the branch 71 which leads to a program element denoted by symbol 72.

This program element checks whether half the document height d, i.e. The height of a document folded double, is greater than the envelope height h minus the intended clearance C1. If this is the case, the program proceeds along branch 73, leading to a program element denoted by symbol 74. In this program element, a value $2(h-C1)-d$ is assigned to an intermediate parameter r. This value corresponds with the distance between the top and bottom edges of the document when it is folded double with a fold at a distance $h-C1$ from the top or the bottom edge. If the fold is provided at a distance $h-C1$ from the top edge, then the lowering of the address field is equal to 0; if the fold is provided at a distance $h-C1$ from the bottom edge, then the lowering of the address field is equal to r. Before opting via the display for this possibility of lowering the position of the address field, it is checked by a further program element denoted by symbol 75 if lowering would make the length of the trailing portion of the document smaller than the minimum length represented by the value C3.

When it has been established that the length of the trailing portion would be too small, the program proceeds along branch 76, leading to a program element, denoted by symbol 77, assigning the value 0 to an intermediate parameter k. If the length of the trailing portion is greater than the minimum length represented by the value C3, the program proceeds along branch 78, leading to a program element, denoted by symbol 79, assigning to the intermediate parameter the value of the intermediate parameter r.

Then a view as denoted by symbol 80 (FIG. 11) is shown on the display, indicating the possible lowering of the address field relative to the starting position, or indicating that only a lowering equal to 0 is possible and offering the operator the choice between running a test cycle and proceeding to a next setting of the apparatus for preparing items to be mailed.

As indicated by symbol 81, it is read in whether or not lowering should take place. Via the program element indicated by symbol 82, the program proceeds along branch 83 if lowering has been chosen. This branch 83 leads to a routine indicated by symbol 84, where the fold height of the first fold obtains a value $h-C1+k$, so that the position of the address field is lowered over a distance k relative to the starting position wherein the top edge of the document is located at a distance of 0 to C1 from the folding edge of that envelope extending along the flap of the envelope. If lowering has not been chosen, the program proceeds along the branch 85 leading to a program element denoted by the symbol 86, where the fold height of the first fold is set at the value $h-C1$, so that no lowering of the position of the address field is obtained. The routines following the symbols 84 and 86, like the routines following symbols 63, 68 and 69, can be of similar design to those of corresponding routines of a folding machine where the number of folds and the fold heights thereof must be inputted by the operator.

Figure 10:
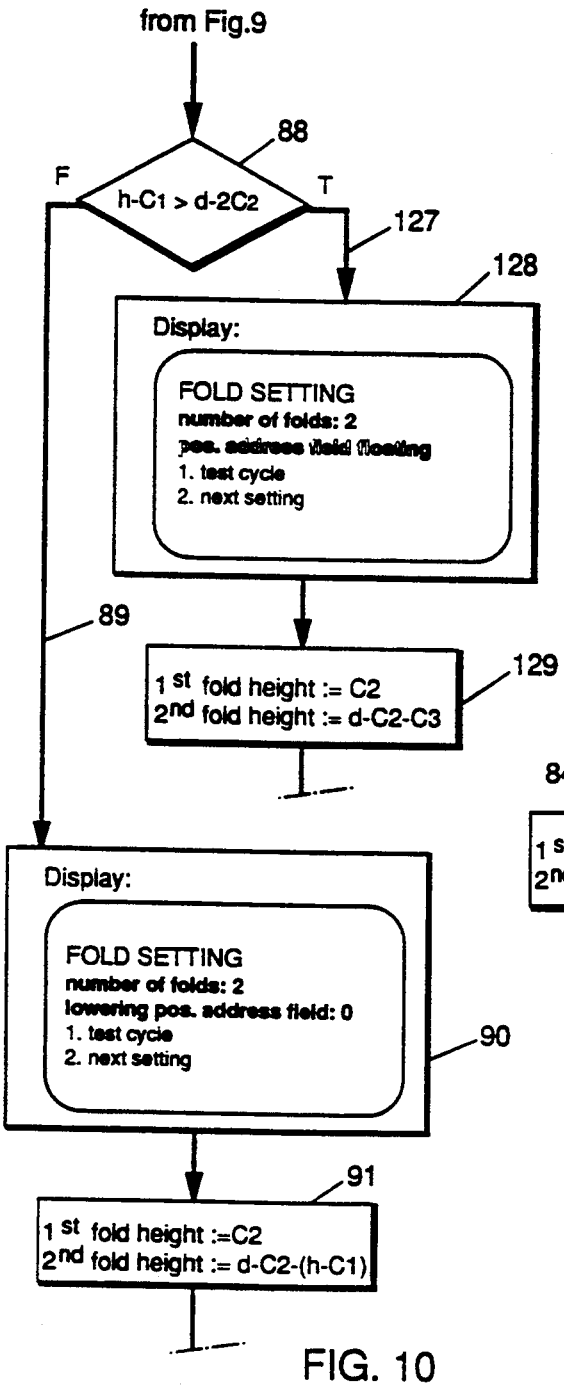
Figure 11:
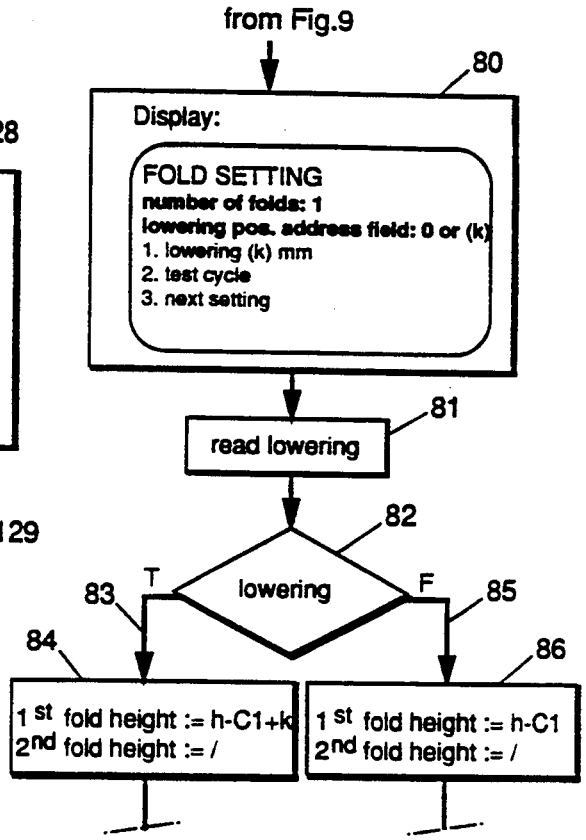
Figure 12:
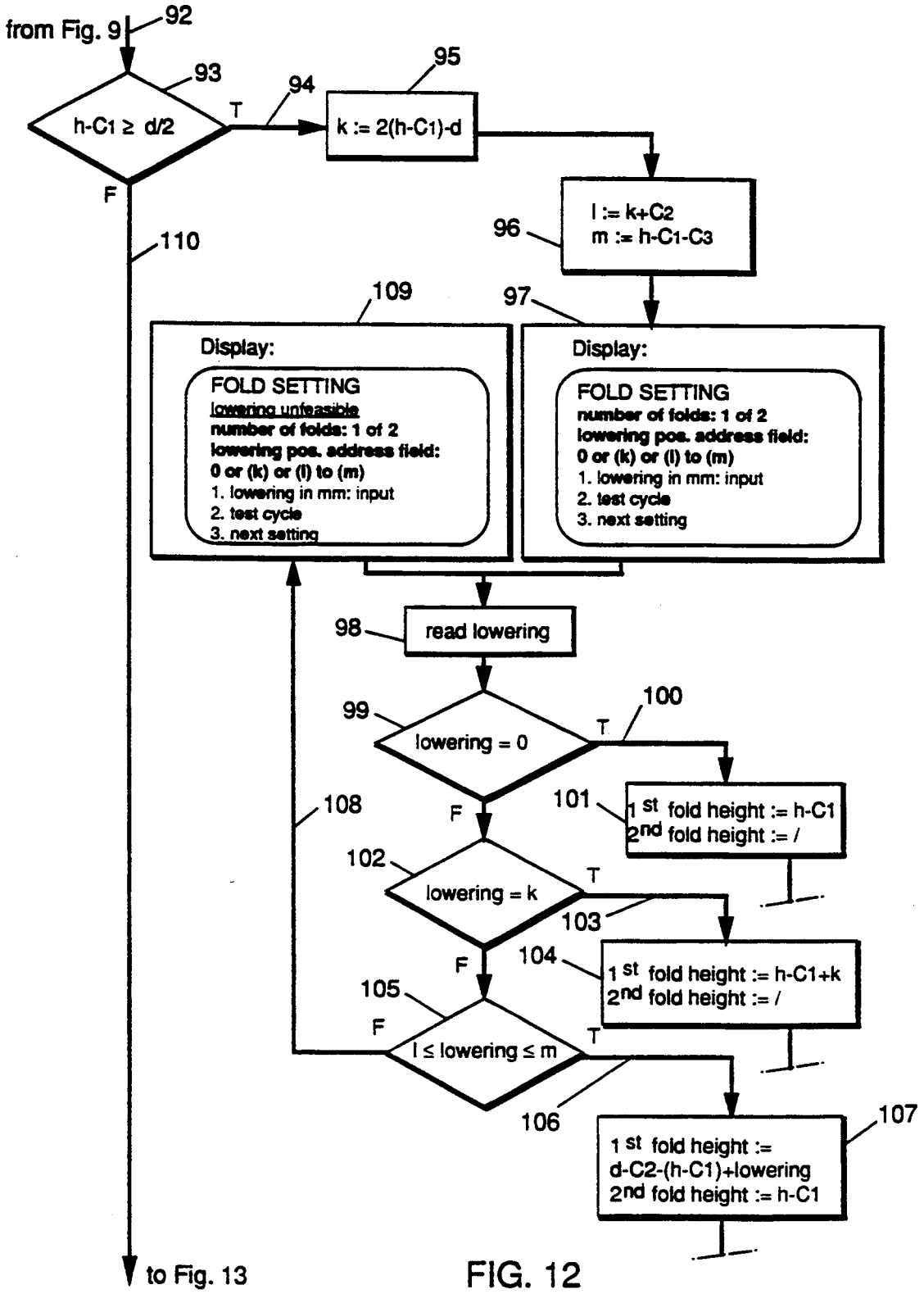
Figure 13:
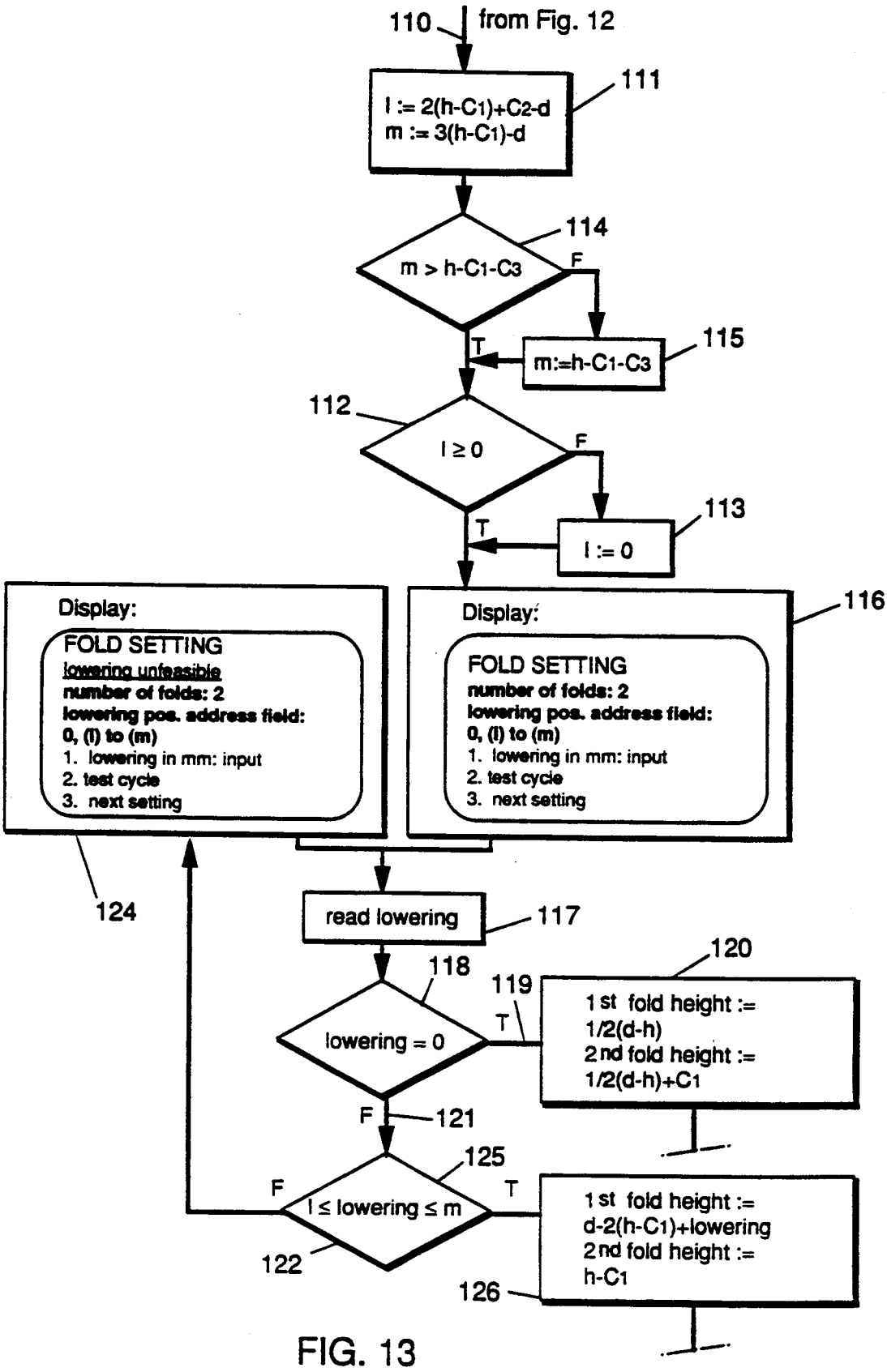

Returning to FIG. 9, symbol 72: if the check run by the program element denoted by symbol 72 reveals that a double-folded document having a single fold is higher than the envelope height h minus the intended clearance C1, the program proceeds along branch 87, leading to the program element denoted by symbol 88 (FIG. 10). This program element checks whether it is possible to provide two folds of a minimum fold height C2 in the document while maintaining a trailing portion of a height $h-C1$, so that a fixed position of the address field relative to the window with the intended clearance C1 is obtained. This possibility is present if the comparison $h-C1>d-2C2$ is false. In that case, the branch 89 is followed, leading to the program element indicated by symbol 90, which controls a display for displaying a view as shown in the referenced symbol 90. As indicated by symbol 91, the fold height of the first fold is set at C2 and the fold height of the second fold is set at $d-C2-(h-C1)$. In virtue of the condition of the program element denoted by symbol 88, the second fold height is always greater than the first fold height, so that a wrapping fold is possible.

If the check run by the program element denoted by symbol 88 reveals that the envelope height h minus the intended clearance C1 is greater than the document height minus twice the minimum fold height C2 of a leading portion, then the program proceeds along branch 127, leading to a program element denoted by the symbol 128. By this program element a display is shown that corresponds with the display of symbol 90, except that instead of indicating a lowering of the position of the address field equal to 0, it indicates that the position of the address field is floating.

As indicated by the symbol 129, subsequently the fold heights are determined for providing a first fold at a minimum distance C2 from the leading edge of the document and a second fold at a minimum distance C3 from the trailing edge.

The program routines following symbols 91 and 129, like the routines following the symbols 63, 68, 69, 84 and 86, can be of a design similar to that of a corresponding routine of a folding machine where the number of folds and the fold heights thereof must be inputted by the operator.

If, on the other hand, the program element denoted by symbol 70 (FIG. 9) has established that the envelope height h minus the intended clearance C1 is not greater than the height of a document having a first fold of a minimum fold height C2 and a second fold of a maximum fold height, i.e. having a distance C3 to the trailing (top) edge, branch 92 is followed, running from FIG. 9 to FIG. 12. A document having two folds as mentioned can be provided with two folds by the folding station, in such a manner that the middle portion between the two folds has a length h−C1 and accordingly fits into the envelope with the intended clearance.

Branch 92 leads to the program element represented by symbol 93, which checks whether the height h of the envelope minus the intended clearance C1 is greater than or equal to half the height d of the document. If such is the case, the folding machine, to give the document a proper fit within the envelope with the intended clearance C1, can provide one or two folds in the document, as desired. The program then proceeds along the branch 94. FIG. 7, discussed hereinabove, shows an example of a document and an envelope, wherein for enabling the document 39 to fit into the envelope 34 with the intended clearance C1, one or two folds 43; 44; or 45, 47; 46, 48 have been provided in documents 39*a*, 39*b*, 39*c* and 39*d*, respectively.

The branch 94 leads to a program element denoted by the symbol 95, which—except that the value is assigned directly to the parameter k—corresponds to the program element 74 (see the discussion thereof). A check such as to be carried out by the program element 75, viz. to establish whether the trailing portion has a height greater than the minimum value C3, can be omitted in view of the check that has already been carried out by the program element denoted by symbol 70.

Subsequently, a program element denoted by symbol 96 is arrived at, which calculates the limits l and m of the lowering range of the address field 42 (see FIG. 7) which is applicable if two folds 45, 47 or 46, 48 (see FIG. 7) are formed. The formulas of the program element denoted by symbol 96 will not require further explanation in view of FIG. 7.

When the possible lowering k for a document in which one fold is formed and the limits l and m of the lowering range in the case of two folds, have been calculated, a program element denoted by symbol 97 controls a display for showing possible lowerings of the address field 42 relative to the window 38 of the envelope 34, starting from the position of the field 42, where the top edge 40 of the document 39, not counting clearance C1, adjoins the folding edge 36 extending along the flap 35 of the envelope 34.

The display of symbol 97 invites the operator to indicate which of the possible lowerings is desired. The desired lowering as inputted by the operator is assigned to the parameter "lowering" by the program element denoted by symbol 98. Then the program elements denoted by symbols 99, 102 and 105 check whether the parameter "lowering" has the value 0, k or a value greater than or equal to l and smaller than or equal to m. Depending on the outcome of these checks, the branches 100, 103 or 106 are followed, leading to the program elements 101, 104, 107 for calculating the fold height. The routines after symbols 101, 104 and 107, like the routines after symbols 63, 68, 69, 84, 86, 91 and 129 can be of a design similar to that of corresponding routines of a folding machine where the number of folds and the fold heights thereof must be inputted by the operator.

If an unfeasible lowering of the position of the address field 42 has been chosen, the program proceeds along the branch 108 leading to a program element indicated by symbol 109, displaying again the possible lowerings of the address field 42 and asking for input of a desired lowering. This program element indicates that an unfeasible lowering of the position of the address field 42 was specified earlier.

If the check carried out by the program element of symbol 93 reveals that the envelope height h minus the intended clearance C1 is not greater than or equal to half the document height d, at least two folds must be formed in the document to permit it to fit into the envelope with the intended clearance C1. In that case, the program proceeds along the branch 110 running from FIG. 12 to FIG. 13.

This branch 110 leads to the program element denoted by symbol 111, which in principle calculates the limits l and m of the feasible lowering range of the position of the address field.

The minimum lowering l follows from the minimum distance, not counting clearance, from the top edge of the document to the folding edge of the envelope that extends along the flap thereof. This minimum distance is in principle equal to the difference between, on the one hand, twice the envelope height h minus twice the intended clearance C1 and, on the other hand, the document height d plus the minimum fold height of the first fold. Further, that distance is greater than or equal to 0. The program elements denoted by symbols 112 and 113 ensure that this condition is met.

By analogy with the minimum lowering 1, the maximum lowering m follows from the maximum distance, not counting clearance, from the top edge of the document to the folding edge of the envelope that extends along the flap thereof. In principle, this maximum distance is equal to the difference between, on the one hand, three times the envelope height h minus three times the intended clearance C1 and, on the other hand, the document height d. However, the distance from the top edge of the document to the folding edge of the envelope opposite the flap must be greater than or equal to the minimum fold height C3 of the trailing portion. Hence, the maximum lowering is moreover at most equal to the difference between, on the one hand, the envelope height h minus the intended clearance C1 and, on the other, the minimum fold height C3. The program elements denoted by symbols 114 and 115 ensure that this condition is met.

The program element denoted by symbol 116 provides a display which indicates the feasible lowering range and asks for input of the desired lowering. The desired lowering is assigned to the parameter "lowering" by the program element denoted by symbol 117.

When the program element denoted by symbol 118 establishes that no lowering is desired, the program proceeds along the branch 119 leading to a program element denoted by symbol 120. This program element calculates the fold heights such that the unfolded portion of the document that is contiguous to the top edge fits into the envelope with the intended clearance C1 and that the remaining portion of the document is folded in two substantially equal parts, a distance of the order of clearance C1 being maintained between the leading portion and the next portion so as to avoid the leading edge butting against the second fold.

When the program element denoted by symbol 118 establishes that a lowering is indeed required, the program proceeds along branch 121, leading to a program element denoted by symbol 122. This program element checks whether the desired lowering is within the feasible lowering range. If such proves to be the case, the program proceeds along branch 125 leading to a program element denoted by symbol 126. This program element calculates the fold heights of the folds, such that the unfolded portion of the document between the two folds fits into the envelope with the intended clearance C1 and the distance between the top edge of the document and the folding edge of the envelope along the flap thereof, not counting clearance, is equal to the inputted lowering.

The program routines following the symbols 120 and 126, like the routines following the program elements denoted by symbols 63, 68, 69, 84, 86, 91, 101, 104, 107 and 129 can be of a design similar to that of corresponding routines of a folding machine where the number of folds and the fold heights thereof must be inputted by the operator.

If the inputted, desired lowering is not within the feasible lowering range, the program proceeds along the branch 123, leading to a program element denoted by symbol 124. This program element corresponds to the program element denoted by symbol 116, except that the display shows in addition that an unfeasible lowering was inputted earlier. From the program element denoted by the symbol 124, the flow of the program links up again with the program element denoted by symbol 117.

The program according to the flowchart shown in FIGS. 8–13 can naturally be adapted and expanded for direct input of the position of the address field and of the envelope. This involves inter alia that the desired lowering—the value of the parameter "lowering"—is calculated at the beginning of the program on the basis of the inputted parameter values representing the positions referred to. The program can also be adapted for folding documents collected into a stack, which requires the incorporation of program elements for determining the relevant document heights and, if necessary, for allowing for any fold-height zones in which no folds can be formed.

What we claim is:

1. A method for setting a folding station included in an apparatus for preparing items to be mailed, said apparatus comprising a document-supply station, an envelope-inserter station, transport means interconnecting said stations and setting means for setting at least the folding machine, said method comprising the steps of:

inputting data into said setting means for setting the fold height of a fold to be formed in at least one document, said data representing at least the height of an envelope intended as a package for said at least one document; and determining and setting said fold height by the setting means, at least partly depending on the inputted data representing the height of the envelope.

2. A method as claimed in claim 1, wherein said setting means comprises data processing means in which a folding program is stored, and said step of inputting comprises the step of inputting a parameter value representing the height of an envelope to be processed to said data processing means and said step of determining and setting comprises the step of determining and setting said fold height by said data processing means in accordance with said parameter value.

3. A method as claimed in claim 1, further comprising the step of inputting data representing the height of the at least one document to be packaged to the setting means and wherein said step of determining and setting comprises the step of determining and setting said fold height by the setting means, partly depending on said inputted data representing the document height.

4. A method as claimed in claim 3, wherein said apparatus comprises sensors arranged in the apparatus for preparing items to be mailed and connected to the setting means, and said method further comprises the step of scanning, using said sensors, the height of the at least one document to be packaged;

generating a signal that is dependent upon the outcome of the step of scanning and represents the height of the at least one document; and inputting said signal to the setting means.

5. A method as claimed in claim 1, wherein said apparatus comprises sensors arranged in the apparatus for preparing items to be mailed and connected to the setting means, and said method further comprises the steps of scanning, using said sensors, the height of an envelope to be processed;

generating a signal that is dependent on the outcome of said step of scanning, and represents the height of sand envelope; and inputting said signal to the setting means.

6. A method as claimed in claim 4, further comprising the steps of:

rolling a scanning roller over the at least one document from a leading to a trailing end thereof; and scanning and registering the rotation of the scanning roller for determining the height of the at least one document.

7. A method as claimed in claim 2, wherein said apparatus comprises sensors arranged in the apparatus for preparing items to be mailed and connected to the setting means, said at least one document comprises a stack of documents, and said method further comprises the steps of scanning, using said sensors, the height of the at least one document to be packaged by scanning the stack in its entirety;

generating a signal that is dependent upon the outcome of said step of scanning and represents the height of the at least one document; and inputting said signal to the setting means.

8. A method as claimed in claim 2, wherein said apparatus comprises sensors arranged in the apparatus for preparing items to be mailed and connected to the setting means, an said method further comprises the steps of:

for each postal item to be prepared from a plurality of documents of mutually different heights scanning, using the sensors the height of each document of the at least one document to be packaged separately;

generating a signal that is dependent upon the outcome of said step of scanning and represents the height of each said document;

inputting each of said signals as a parameter value to the data processing means; determining, in said data processing means, which parameter value represents the greatest height; and using said parameter representing the greatest height as a starting point for determining the fold height.

9. A method as claimed in claim 8, wherein said at one document comprises a stack of documents whose top or bottom edges are superposed in a straight line in the stacking direction, and said method further comprising the steps of:

determining which parameter values represent document heights of documents whose respective oppositely disposed edge is located on the outside of the stack; and using these parameter values in determining a fold height for determining and avoiding fold-height zones where no fold can be provided.

10. A method as claimed in claim 2, further comprising the steps of:

inputting at least one reference value which represents a possible property of a set of documents to be processed into a postal item into the data processing means;

determining, for each set of documents to be processed into a postal item, at least one parameter value which represents a property of a set of documents to be processed into a postal item;

inputting said at least one parameter value into the data processing means;

comparing said parameter value with said reference value using the data processing means;

choosing, on the basis of the outcome of said step of comparing, for each postal item to be prepared, one envelope, from at least two envelopes of mutually different heights;

inputting at least the parameter value representing the height of the envelope chosen to the data processing means; and using, by said data processing means, said parameter value as the starting point for determining the fold height.

11. A method as claimed in claim 10, wherein the step of determining said at least one parameter value representing a property of a set of documents to be processed into a postal item comprises the step of determining the number of documents from which said set has been or is being prepared.

12. A method as claimed in claim 10, wherein the step of determining said at least one parameter value representing a property of a set of documents to be processed into a postal item comprises the step of determining whether from a given document-supply station a document has been supplied.

13. A method as claimed in claim 12, further comprising the steps of:

associated with at least one document-supply station, a parameter value which represents a height of a part that is not to be folded of a document to be supplied by said supply-station;

choosing an envelope if a document is supplied from said document-supply station, using said parameter value as said at least one parameter value representing a property of a set of documents to be processed into a postal item for determining a required minimum envelope height; and using said parameter value in determining a fold height for determining the fold-height zones to be avoided.

14. A method as claimed in claim 9, wherein said step of determining said at least one parameter value representing a property of a set of documents to be processed into a postal item comprises the step of determining the weight of the set of documents in question.

15. A method as claimed in claim 9, further comprising the steps of:

inputting at least one reference value which represents a possible property of a set of documents to be processed into a postal item into the data processing means;

determining, for each set of documents to be processed into a postal item, at least one parameter value which represents a property of a set of documents to be processed into a postal item;

inputting said at least one parameter value into the data processing means;

comparing said parameter value with said reference value using the data processing means;

choosing, on the basis of the outcome of said step of comparing, for each postal item to be prepared one envelope, from at least two envelopes of mutually different heights;

inputting at least the parameter value representing the height of the envelope chosen to the data processing means;

using said data processing means, said parameter value as the starting point for determining the fold height; and selecting, if the fold height which has been determined for packaging a set of documents in the envelope chose falls within a fold-height zone where no folds can be provided, via the data processing means, a different envelope of a height that differs from the height of the envelope initially chosen.

16. A method as claimed in claim 2, further comprising the steps of:

inputting, a first parameter value representing a distance from an edge of an address field on a document to be processed to a top or bottom edge of said document;

inputting, to the data processing means, a second parameter value representing a distance from an edge of a window in an envelope intended for packaging said document to a top or bottom edge of said envelope, wherein the step of determining and setting the fold heights by the data processing means is performed such that after insertion of a document into the envelope, the address field is located behind the window of said envelope and at least the document that carries the address field fits into the envelope with a slight clearance in the direction of the height.

17. A method as claimed in claim 2, wherein said envelope comprises a given type of window envelope and said at least one document comprises a given type of document with an address field, said given type of document adapted to fit into the corresponding envelope with a slight clearance in height after being folded at least once, said method further comprising the steps of:

after the step of determining and setting a fold height of said fold, performing a correction cycle at least once, said step of performing a correction cycle comprising the steps of controlling, via the data processing means, a display for indicating the possible displacement of the fold in height direction as a possible displacement of the address field in height direction relative to the window;

performing a test cycle comprising the step of processing a same document with an address field as said given type of document and a same envelope as said given type envelope into a postal item and inputting, via the operator, to the data processing means, a parameter value representing a desired displacement of the address in height direction relative to the window; and after the step of performing a final correction cycle, storing the fold height found in the data processing means.

18. A method as claimed in claim 1, further comprising the step of storing at least the nominal clearance of a document or set of documents within the envelope in the data processing means as a fixed preferred setting.

19. A method as claimed in claim 1, further comprising the step of storing a choice between a zigzag folding manner and a wrapping folding manner regarding the document in the data processing means as a fixed preferred setting.

20. A method as claimed in claim 5, further comprising the steps of:

rolling a scanning roller over the envelope from a leading to a trailing end thereof;

scanning and registering the rotation of the scanning roller for determining the height of the envelope.

21. Apparatus for preparing items to be mailed, comprising at least one document-supply station, a folding station which can be set for determining a fold height of a fold to be provided in at least one document supplied from the at least one document-supply station, and an envelope-inserter station, said stations being interconnected by transport means, and setting means for setting the folding station and comprising input means for inputting at least data which represent the height of an envelope to be processed, the setting means for determining and setting the fold height of said fold, depending on said inputted data.

22. Apparatus as claimed in claim 21, wherein:

the setting means further comprises data processing means having stored therein a folding program for setting the folding station, the input means are connected to said data processing means for inputting said data as a parameter value; and the folding program includes:

at least one input parameter for storing said parameter value, an output parameter for setting the folding machine, and an algorithm for assigning a parameter value to the output parameter, depending on the parameter value assigned to said input parameter.

23. Apparatus as claimed in claim 22, wherein said input means are further adapted for inputting a parameter value representing the height of said document to be folded and to be packaged in said envelope, for determining the fold height of at least one fold to be made relative to an edge of said document to be folded, partly depending on the inputted parameter value representing the height of said document.

24. Apparatus as claimed in claim 22, further comprising measuring instruments for determining a parameter value representing the height of an envelope to be processed, said measuring instruments being coupled to the input means for inputting said parameter value representing the height of an envelope.

25. Apparatus as claimed in claim 23, further comprising measuring instruments for determining the parameter value which represents the height of a document to be processed, said measuring instruments being coupled to the input means for inputting said parameter value representing the height of a document.

26. Apparatus as claimed in claim 23, further comprising:

supply means for supplying a plurality of documents for each postal item to be prepared, said supply means being arranged for supplying documents of different heights;

collecting means for collecting the documents supplied for each postal item into a stack, comprising a stop for the documents to abut against in a height direction;

the measuring instruments for determining the parameter value representing the height of a document to be processed comprising scanning means for scanning the height of the highest document of a set of documents collected into a stack in abutment with the stop and to be processed into a postal item, measured from said stop.

27. Apparatus as claimed in claim 22, wherein:

said input means are further adapted for inputting a parameter value representing the height of said document to be folded and to be packaged in said envelope, for determining the fold height of at least one fold to be made relative to an edge of said document to be folded, partly depending on the inputted parameter value representing the height of said document;

said apparatus further comprising:

supply means for supplying a plurality of documents for each postal item to be prepared, said supply means being arranged for supplying documents of mutually different heights;

collecting means for collecting the documents supplied for each postal item into a stack, comprising a stop for the documents to abut against in a height direction;

measuring instruments for determining for each document being supplied a parameter value representing the height of said document; and a folding program routine incorporated in the folding program for setting the folding station, which routine includes: input parameters for storing the parameter values each associated with one of the documents, representing the height of said respective document, an intermediate parameter for indicating the height of the highest document of a stack and an algorithm for assigning a value to said intermediate parameter, depending on the inputted parameter value, each representing a height of one of the documents supplied.

28. Apparatus as claimed in claim 27, wherein said folding program routine further includes:

intermediate parameters for storing the heights of documents of which a top or bottom edge is located on the outside of a stack of documents to be processed into a postal item, collected into a stack;

output parameters for indicating fold-height zones to be excluded; and an algorithm for assigning parameter values to the intermediate parameters, depending on the values and the sequence of the input parameters, as well as for determining said output parameters, depending on the values of the intermediate parameters.

29. Apparatus as claimed in claim 22, wherein the inserter station comprises:

at least two envelope-supply holders;

supply means for supplying an envelope from one of said envelope-supply holders;

actuating means for actuating a given envelope-supply holder for each postal item to be prepared, for supplying an envelope, which actuating means are connected to the data processing means, wherein said data processing means stores an envelope-selection program comprising:

at least one input parameter for storing a parameter value which represents the envelope height of an envelope present in one of the supply holders, at least one input parameter for storing a parameter value representing a property of a set of documents to be packaged;

at least one input parameter for storing a reference value with which the last-mentioned parameter value is compared;

an output parameter for actuating one of the envelope-supply holders; and an algorithm for assigning a value to the output parameter for actuating one of the envelope holders, depending on the outcome of said comparison.

30. Apparatus as claimed in claim 25, wherein the measuring instruments comprise:

a scanning roller which engages a surface in the area of a transport track;

associated data processing means; and a rotation sensor adapted to generate to the associated data processing means a signal representing the path the scanning roller has traversed over an envelope or at least one document passed along said scanning roller in a height direction.

31. A folding station for preparing items to be mailed, and adapted to fold documents of various sizes to be inserted into envelopes of various sizes, said folding station comprising:

means for folding at least one document to be inserted into an envelope in accordance with a selected fold height;

means for inputting data representing the height of the envelope;

means for determining the fold height in accordance with said inputted data; and means for setting the fold height in accordance with the determined fold height.

* * * * *